US007975626B1

(12) United States Patent
Wang et al.

(10) Patent No.: US 7,975,626 B1
(45) Date of Patent: Jul. 12, 2011

(54) COMPUTER TABLE THAT IS FOLDED EASILY AND QUICKLY

(75) Inventors: Pi-Liang Wang, Dong Guan (CN); Cheng-Chun Wang, Changhua (TW); Zi-Cong Wen, Dongguan (CN); Chen-Yu Chung, Taichung (TW)

(73) Assignee: Pi-Liang Wang, Dong Guan, Guangdong Province (CN)

( * ) Notice: Subject to any disclaimer, the term of this patent is extended or adjusted under 35 U.S.C. 154(b) by 0 days.

(21) Appl. No.: 12/853,350

(22) Filed: Aug. 10, 2010

(51) Int. Cl.
*A47B 3/00* (2006.01)

(52) U.S. Cl. ..... 108/115; 108/50.01

(58) Field of Classification Search ..... 108/115, 108/50.01, 159.11, 157.15, 157.18, 157.1, 108/157.17, 159, 27; 248/188, 188.1, 188.6
See application file for complete search history.

(56) References Cited

U.S. PATENT DOCUMENTS 1,904,897 A * 4/1933 Wright ..... 108/90
4,568,212 A * 2/1986 Cooke et al. ..... 108/50.01
4,974,526 A * 12/1990 Wiygul, Jr. ..... 108/157.1
5,287,815 A * 2/1994 Gross ..... 108/50.01
5,345,882 A * 9/1994 Yamada ..... 108/180
5,421,272 A * 6/1995 Wilmore ..... 108/115
5,634,411 A * 6/1997 Chasan ..... 108/153.1
5,904,104 A * 5/1999 Yu ..... 108/115
6,082,838 A * 7/2000 Bissu-Palombo ..... 108/50.01
6,220,187 B1 * 4/2001 Grosser ..... 108/158
6,799,816 B2 * 10/2004 Touzani ..... 312/223.3
6,994,034 B2 * 2/2006 Chang ..... 108/115
6,997,115 B2 * 2/2006 Lockwood et al. ..... 108/115
2005/0274300 A1 * 12/2005 Chen ..... 108/115

* cited by examiner

*Primary Examiner* — José V Chen
(74) *Attorney, Agent, or Firm* — Alan Kamrath; Kamrath & Associates PA

(57) ABSTRACT

A computer table includes a rear frame, two side frames pivotally mounted on two opposite ends of the rear frame respectively, a support board detachably mounted on the rear frame and the two side frames to support a computer, a drawer board detachably mounted between the two side frames, and a carrier detachably mounted on one of the two side frames to support a host frame of the computer. Thus, the computer table can be folded to have a smaller volume to decrease the cost of packaging, storage and transportation of the computer table.

3 Claims, 6 Drawing Sheets

COMPUTER TABLE THAT IS FOLDED EASILY AND QUICKLY

BACKGROUND OF THE INVENTION

1. Field of the Invention

The present invention relates to a table and, more particularly, to a computer table for mounting a computer.

2. Description of the Related Art

A conventional computer table is used for mounting a computer to facilitate a user operating the computer. However, the conventional computer table cannot be folded to have a smaller volume when not in use, thereby increasing the cost of packaging, storage and transportation of the computer table. In addition, the conventional computer table is not assembled and disassembled easily and quickly, thereby causing inconvenience to a user when assembling and disassembling the computer table.

BRIEF SUMMARY OF THE INVENTION

In accordance with the present invention, there is provided a computer table, comprising a rear frame, two side frames pivotally mounted on two opposite ends of the rear frame respectively, a support board detachably mounted on the rear frame and the two side frames to support a computer, a drawer board detachably mounted between the two side frames, and a carrier detachably mounted on one of the two side frames to support a host frame of the computer.

Each of the two opposite ends of the rear frame has an upper portion and a lower portion each provided with a first pivot portion. Each of the two side frames has a rear end having an upper portion and a lower portion each provided with a second pivot portion pivotally connected with the respective first pivot portion of the rear frame by a pivot pin so that the rear end of each of the two side frames is pivotally connected with the rear frame. Each of the two side frames has a front end having an upper portion formed with an elongate locking slot. The support board has a front end provided with two locking pieces each inserted into and detachably locked in the locking slot of a respective one of the two side frames to attach the support board to the two side frames. Each of the two side frames has a mediate portion having an upper portion formed with an elongate guide track. The drawer board has two opposite ends each detachably mounted in and guided by the guide track of a respective one of the two side frames. The support board has a rear end provided with a threaded locking plate locked onto the rear frame by a threaded locking knob to attach the support board to the rear frame. The threaded locking knob is extended through the rear frame and is screwed into the threaded locking plate of the support board. The threaded locking plate of the support board abuts the rear frame. The carrier has a side provided with at least one hanging hook detachably hooked onto a lower portion of one of the two side frames to attach the carrier to one of the two side frames.

The primary objective of the present invention is to provide a computer table that is folded easily and quickly.

According to the primary advantage of the present invention, the computer table can be folded to have a smaller volume so as to decrease the cost of packaging, storage and transportation of the computer table.

According to, another advantage of the present invention, the computer table is assembled and disassembled easily and quickly, thereby facilitating a user assembling and disassembling the computer table.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
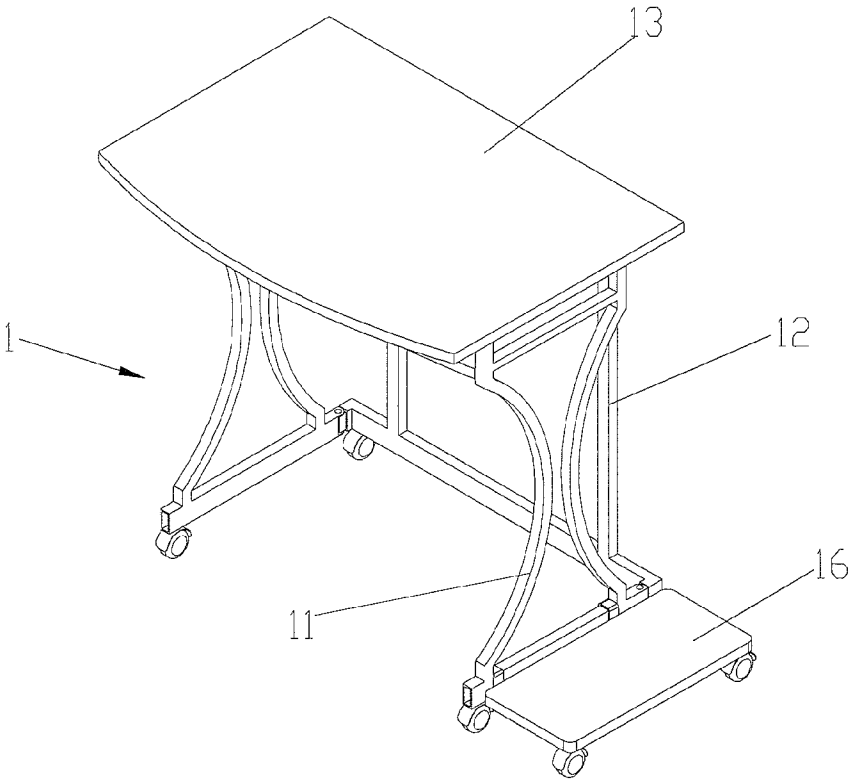
FIG. 1 is a perspective view of a computer table in accordance with the preferred embodiment of the present invention.
Figure 2:
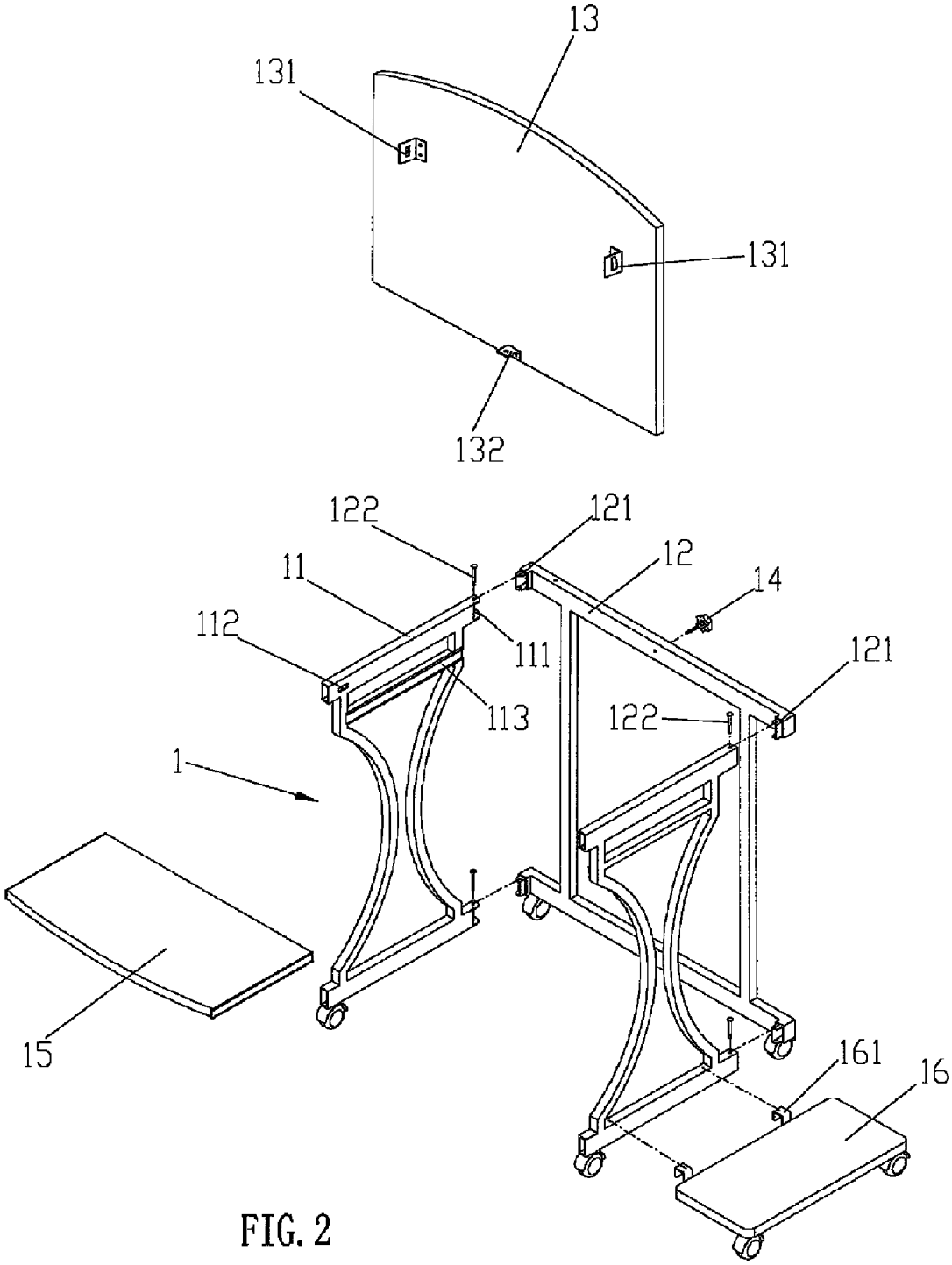
FIG. 2 is an exploded perspective view of the computer table as shown in FIG. 1.
Figure 3:
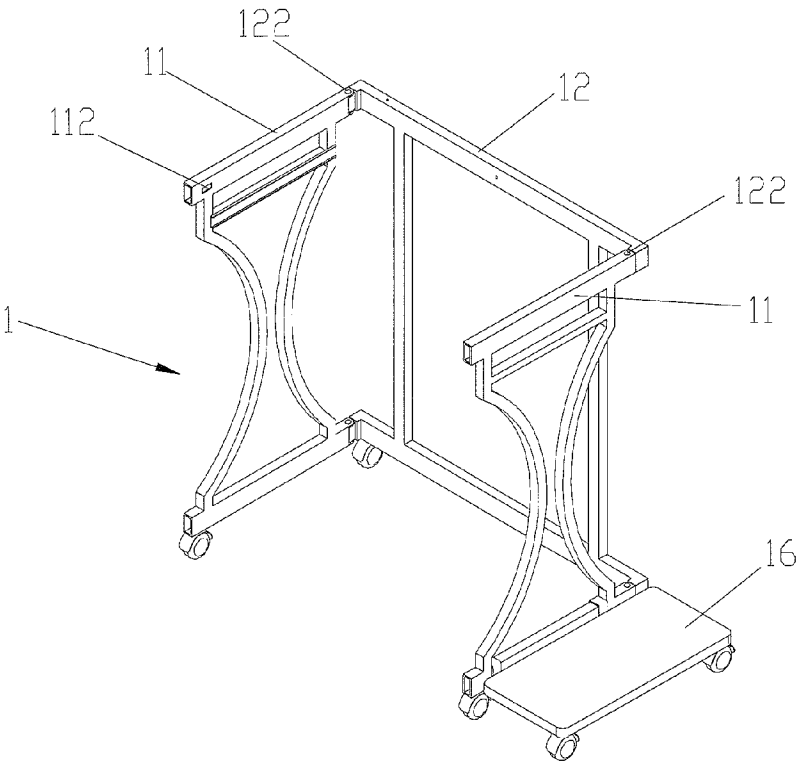
FIG. 3 is a partially perspective view of the computer table as shown in FIG. 1.
Figure 4:
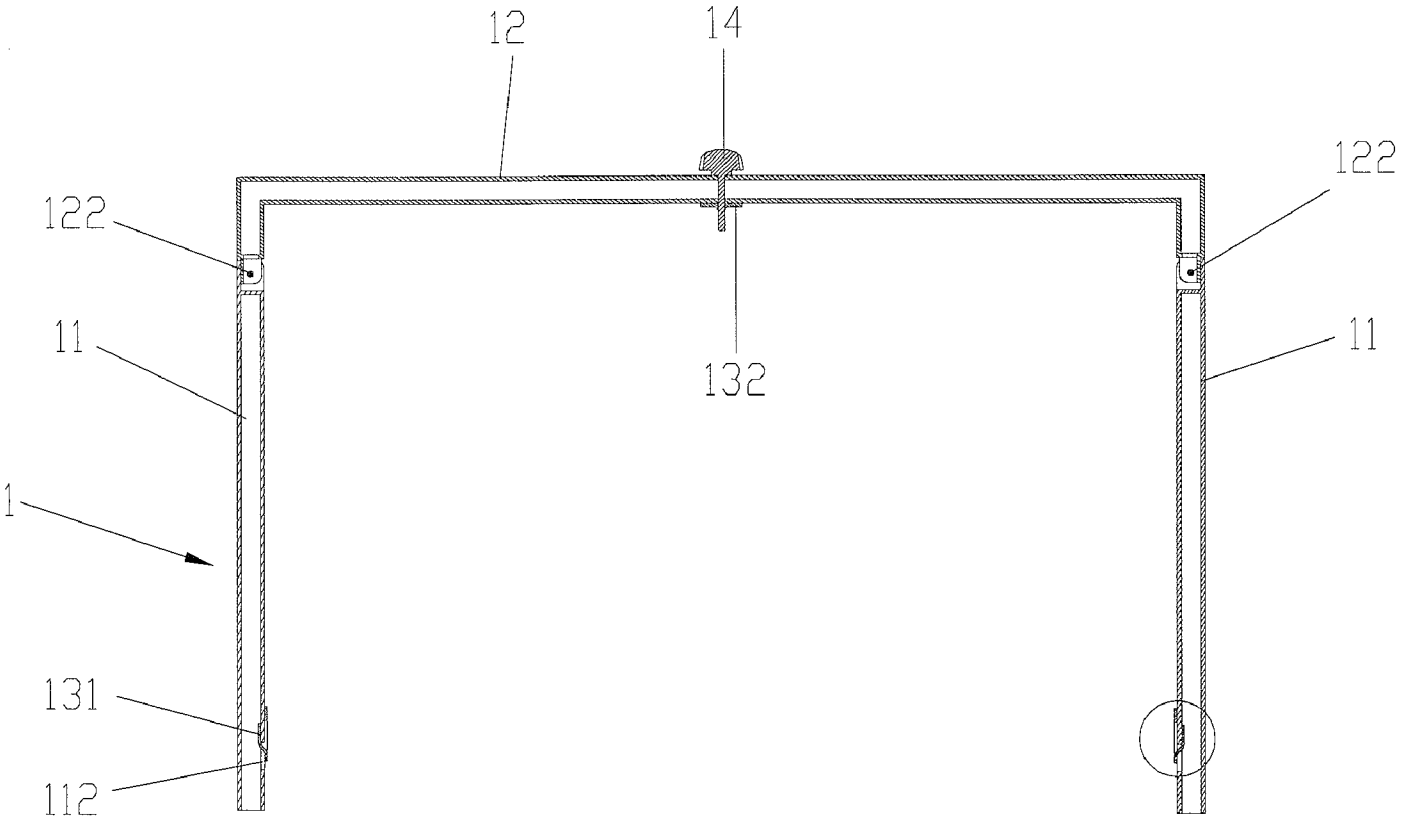
FIG. 4 is a top cross-sectional view of the computer table as shown in FIG. 3.

Referring to the drawings and initially to FIGS. 1-6, a computer table 1 in accordance with the preferred embodiment of the present invention comprises a rear frame 12, two side frames 11 pivotally mounted on two opposite ends of the rear frame 12 respectively, a support board 13 detachably mounted on the rear frame 12 and the two side frames 11 to support a computer, a drawer board 15 detachably mounted between the two side frames 11, and a carrier 16 detachably mounted on one of the two side frames 11 to support a host frame of the computer.

Each of the two opposite ends of the rear frame 12 has an upper portion and a lower portion each provided with a first pivot portion 121.

Each of the two side frames 11 has a rear end having an upper portion and a lower portion each provided with a second pivot portion 111 pivotally connected with the respective first pivot portion 121 of the rear frame 12 by a pivot pin 122 so that the rear end of each of the two side frames 11 is pivotally connected with the rear frame 12. Each of the two side frames 11 has a front end having an upper portion formed with an elongate locking slot 112. Each of the two side frames 11 has a mediate portion having an upper portion formed with an elongate guide track 113. The guide track 113 of each of the two side frames 11 is disposed between the second pivot portion 111 and the locking slot 112.

The drawer board 15 has two opposite ends each detachably mounted in and guided by the guide track 113 of a respective one of the two side frames 11.

The carrier 16 has a side provided with at least one hanging hook 161 detachably hooked onto a lower portion of one of the two side frames 11 to attach the carrier 16 to one of the two side frames 11.

The support board 13 has a front end provided with two locking pieces 131 each inserted into and detachably locked in the locking slot 112 of a respective one of the two side frames 11 to attach the support board 13 to the two side frames 11. Each of the two locking pieces 131 of the support board 13 has a substantially Z-shaped profile. The support board 13 has a rear end provided with a threaded locking plate 132 locked onto the rear frame 12 by a threaded locking knob 14 to attach the support board 13 to the rear frame 12. The threaded locking plate 132 of the support board 13 abuts the rear frame 12. The threaded locking knob 14 is extended through the rear frame 12 and is screwed into the threaded locking plate 132 of the support board 13.

Figure 5:
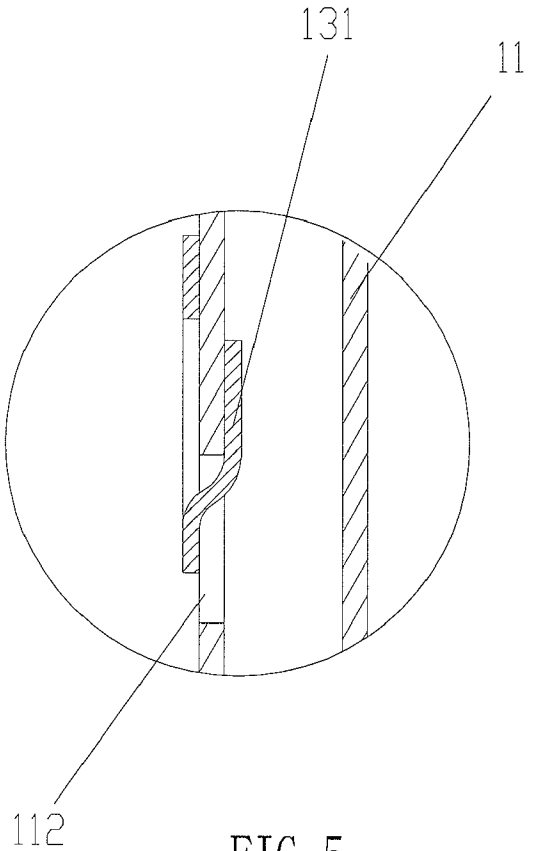
FIG. 5 is a locally enlarged view of the computer table as shown in FIG. 4.

In assembly, the second pivot portion 111 of each of the two side frames 11 is pivotally connected with the respective first pivot portion 121 of the rear frame 12 by the pivot pin 122 so that the rear end of each of the two side frames 11 is pivotally connected with the rear frame 12. Then, each of the two locking pieces 131 of the support board 13 is inserted into the locking slot 112 of the respective side frame 11. Then, the support board 13 is moved rearward relative to the two side frames 11 so that each of the two locking pieces 131 of the support board 13 is locked in the locking slot 112 of the respective side frame 11 as shown in FIG. 5 to attach the support board 13 to the two side frames 11. Then, the threaded locking knob 14 is extended through the rear frame 12 and is screwed into the threaded locking plate 132 of the support board 13 to attach the support board 13 to the rear frame 12. Then, the drawer board 15 is inserted into and located between the guide tracks 113 of the two side frames 11. Finally, the hanging hook 161 of the carrier 16 is hooked onto one of the two side frames 11 to attach the carrier 16 to one of the two side frames 11 so as to assemble the computer table 1 as shown in FIG. 1.

Figure 6:
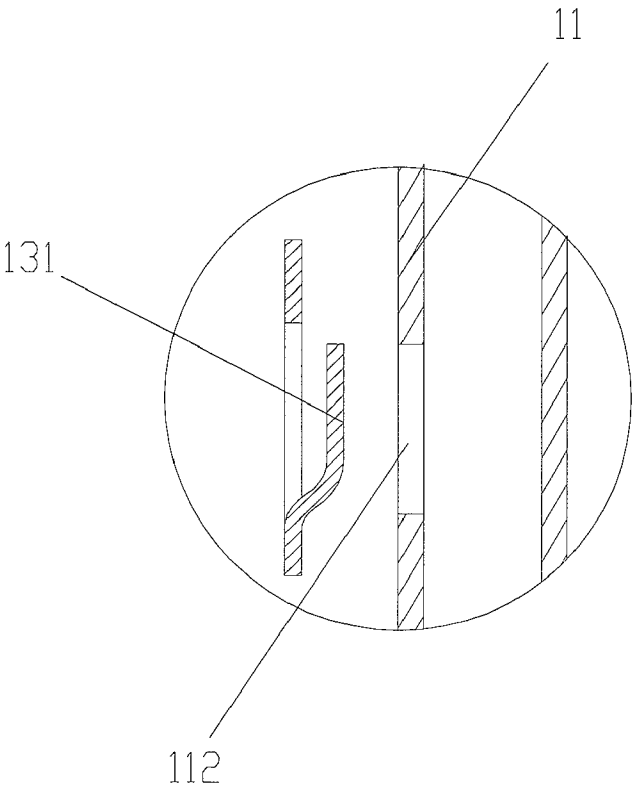
FIG. 6 is a schematic operational view of the computer table as shown in FIG. 5.
Figure 7:
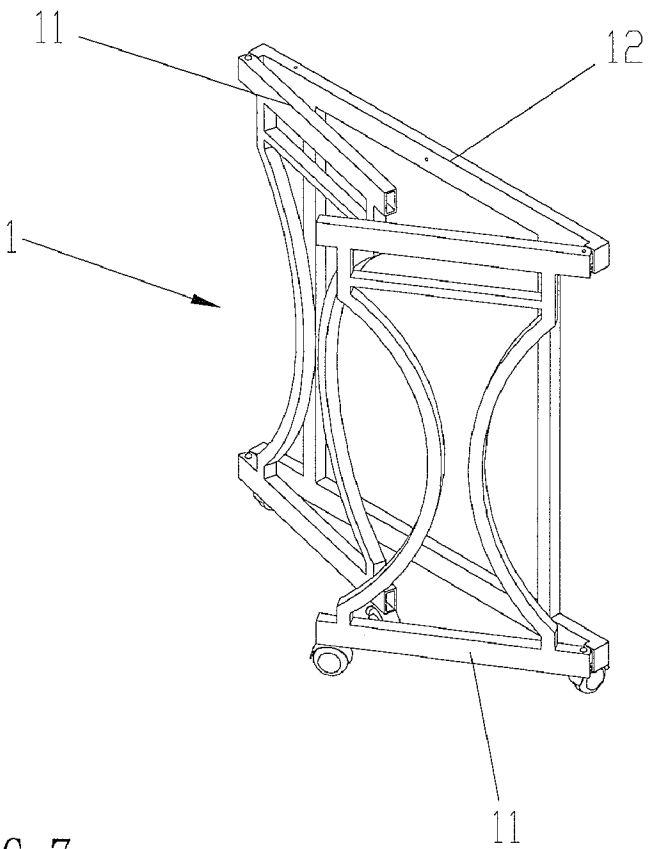
FIG. 7 is a perspective folded view of the computer table as shown in FIG. 1.

When not in use, referring to FIG. 7 with reference to FIGS. 1-6, the hanging hook 161 of the carrier 16 is detached from one of the two side frames 11 to remove the carrier 16 from one of the two side frames 11. Then, the drawer board 15 is removed from the guide tracks 113 of the two side frames 11. Then, the threaded locking knob 14 is unscrewed from the threaded locking plate 132 of the support board 13 and is removed from the rear frame 12 to detach the support board 13 from the rear frame 12. Finally, the support board 13 is moved forward relative to the two side frames 11 so that each of the two locking pieces 131 of the support board 13 is unlocked and detached from the locking slot 112 of the respective side frame 11 as shown in FIG. 6 to detach the support board 13 from the two side frames 11. Thus, the support board 13 can be removed from the rear frame 12 and the two side frames 11. In such a manner, after the support board 13 is removed from the rear frame 12 and the two side frames 11, each of the two side frames 11 is pivoted relative to the rear frame 12 so that each of the two side frames 11 can be moved to abut the rear frame 12 so as to fold the computer table 1 as shown in FIG. 7.

Accordingly, the computer table 1 can be folded to have a smaller volume so as to decrease the cost of packaging, storage and transportation of the computer table 1. In addition, the computer table 1 is assembled and disassembled easily and quickly, thereby facilitating a user assembling and disassembling the computer table 1.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A computer table, comprising:

a rear frame;

two side frames pivotally mounted on two opposite ends of the rear frame respectively;

a support board detachably locked onto the rear frame and the two side frames to support a computer;

a drawer board detachably mounted between and abutting the two side frames; and a carrier detachably mounted on one of the two side frames to support a host frame of the computer;

wherein each of the two opposite ends of the rear frame has an upper portion and a lower portion each provided with a first pivot portion; and each of the two side frames has a rear end having an upper portion and a lower portion each provided with a second pivot portion pivotally connected with the respective first pivot portion of the rear frame by a pivot pin which is extended through the second pivot portion and the respective first pivot portion of the rear frame so that the rear end of each of the two side frames is pivotally connected with the rear frame;

each of the two side frames has a front end having an upper portion having an inner face formed with an elongate locking slot;

the locking slots of the two side frames face each other;

the support board has a front end having a bottom provided with two locking pieces each inserted into and detachably locked in the locking slot of a respective one of the two side frames to attach the support board to the two side frames;

the drawer board abuts an inner face of each of the two side frames;

each of the two side frames has a mediate portion having an upper portion formed with an elongate guide track;

the drawer board has two opposite ends each detachably mounted in and guided by the guide track of a respective one of the two side frames;

the guide track of each of the two side frames is spaced from the support board;

the guide track of each of the two side frames is disposed between the second pivot portion and the locking slot;

the support board has a rear end having a bottom provided with a threaded locking plate locked onto the rear frame by a threaded locking knob to attach the support board to the rear frame;

the threaded locking plate of the support board has a substantially inverted L-shaped profile;

the threaded locking plate of the support board abuts a top of the rear frame;

the threaded locking knob is extended through the top of the rear frame and is screwed into the threaded locking plate of the support board to lock the threaded locking plate of the support board onto the rear frame;

the two locking pieces and the threaded locking plate of the support board form a three-point connection between the support board, the rear frame and the two side frames so that the support board is fixed by the rear frame and the two side frames.

2. The computer table of claim 1, wherein the carrier has a side provided with at least one hanging hook detachably hooked onto a hollow lower portion of one of the two side frames to attach the carrier to one of the two side frames.

3. The computer table of claim 1, wherein each of the two side frames has a height flush with that of the rear frame.

* * * * *